US009433993B2

(12) United States Patent
Houle et al.

(10) Patent No.: US 9,433,993 B2
(45) **Date of Patent: *Sep. 6, 2016**

(54) FLARING AND EXPANDING TOOLS AND METHODS OF FLARING AND EXPANDING TUBES AND PIPES

(71) Applicant: Irwin Industrial Tool Company, Huntersville, NC (US)

(72) Inventors: Joseph J. Houle, Westfield, MA (US); David Wortelboer, Springfield, MA (US)

(73) Assignee: Irwin Industrial Tool Company, Huntersville, NC (US)

( * ) Notice: Subject to any disclaimer, the term of this patent is extended or adjusted under 35 U.S.C. 154(b) by 31 days.

This patent is subject to a terminal disclaimer.

(21) Appl. No.: 14/488,913

(22) Filed: Sep. 17, 2014

(65) Prior Publication Data

US 2015/0000364 A1 Jan. 1, 2015

Related U.S. Application Data

(63) Continuation of application No. 13/426,588, filed on Mar. 21, 2012, now Pat. No. 8,869,581.

(60) Provisional application No. 61/454,842, filed on Mar. 21, 2011.

(51) Int. Cl.
*B21D 41/02* (2006.01)

(52) U.S. Cl.
CPC ..... *B21D 41/021* (2013.01)

(58) Field of Classification Search
CPC .... B21D 41/00; B21D 41/02; B21D 41/021; B21D 19/08; B25B 5/00; B25B 5/14; B25B 5/147
See application file for complete search history.

(56) References Cited

U.S. PATENT DOCUMENTS

| | | | |
|---|---|---|---|
| 1,372,197 | A | 3/1921 | Rudolph |
| 1,765,704 | A | 6/1930 | Schultis |
| 1,775,766 | A | 9/1930 | Holmes |
| 1,985,454 | A | 12/1934 | McCabe |
| 2,118,361 | A | 5/1938 | Schaeffer, Jr. |
| 2,124,743 | A | 7/1938 | McMahon |
| 2,350,054 | A | 5/1944 | McIntosh |
| 2,352,912 | A | 7/1944 | Parker |
| 2,370,089 | A | 2/1945 | Swyers |

(Continued)

OTHER PUBLICATIONS

International Search Report & Written Opinion for International Application No. PCT/US12/30015 dated Jun. 13, 2012.

(Continued)

*Primary Examiner* — Teresa M Ekiert
(74) *Attorney, Agent, or Firm* — Sutherland Asbill & Brennan LLP

(57) ABSTRACT

Compact tube and pipe expanders and flaring tools requiring reduced actuation force by a user. A flaring tool includes a flaring block and a yoke clampable to the flaring block by a clamping mechanism. The yoke includes a housing having a threaded release portion movable between a first position and a second position. A flaring cone of the yoke has a tapered flaring surface adapted to engage an internal surface of a tube and deform at least the engaged portion of the tube against the flaring block into a flared condition. A threaded feed screw is operatively coupleable to the flaring cone to move the flaring cone into engagement with the internal surface of the tube to deform it. The tool has a handle to rotate the feed screw.

20 Claims, 12 Drawing Sheets

(56) References Cited

U.S. PATENT DOCUMENTS

| | | | |
|---|---|---|---|
| 2,442,495 | A | 6/1948 | Hull et al. |
| 2,466,422 | A | 4/1949 | Hartley et al. |
| 2,505,666 | A | 4/1950 | Franck |
| 2,707,511 | A | 5/1955 | Franck |
| 2,737,225 | A | 3/1956 | Jasinski |
| 2,861,623 | A | 11/1958 | Franck |
| 2,893,463 | A | 7/1959 | Kowal |
| 2,893,464 | A | 7/1959 | Franck |
| 2,924,263 | A | 2/1960 | Landis |
| 2,936,810 | A | 5/1960 | Franck |
| 2,962,079 | A | 11/1960 | Wilson |
| 3,011,539 | A | 12/1961 | Henrickson |
| 3,050,103 | A | 8/1962 | Janik |
| 3,195,337 | A | 7/1965 | Janik |
| 3,262,297 | A | 7/1966 | Samuels et al. |
| 3,262,298 | A | 7/1966 | Samuels et al. |
| 3,380,273 | A | 4/1968 | Champion |
| 3,477,265 | A | 11/1969 | Szitar, Jr. |
| 4,526,023 | A | 7/1985 | Babb |
| 5,228,323 | A | 7/1993 | Dubinsky et al. |
| 5,230,596 | A | 7/1993 | Morad |
| 8,869,581 | B2 | 10/2014 | Houle et al. |

OTHER PUBLICATIONS

Ritchie Engineering Company, Yellow Jacket Flare Burnish Tool.

Ritchie Engineering Company, Yellow Jacket Deluxe 45° Flaring Tool.

FLARING AND EXPANDING TOOLS AND METHODS OF FLARING AND EXPANDING TUBES AND PIPES

CROSS-REFERENCE TO RELATED APPLICATIONS

This application is a continuation of U.S. patent application Ser. No. 13/426,588, filed Mar. 21, 2012, the disclosure of which is incorporated herein by reference in its entirety, which claims the benefit for U.S. Patent Application Ser. No. 61/454,842 filed Mar. 21, 2011, the disclosure of which is incorporated herein by reference in its entirety.

FIELD OF THE INVENTION

The present invention relates to tools for flaring and expanding the ends of tubes and pipes. More particularly, the invention relates to hand tools for flaring and expanding pipes and tubes.

BACKGROUND INFORMATION

Flaring and expanding tools are used to expand the internal and/or external dimensions of the end of a tube or pipe for swaging or joining pipe or for other plumbing and piping applications. Generally, a tool or head is inserted into the end of the tube, forcing the tube material outward to plastically deform the tube end into the desired shape or flare. The inventors have discerned a number of disadvantages of previously-known flaring and expanding tools.

One disadvantage is that such tools are difficult to set-up and operate. Even when the workpiece is a relatively soft material, such as annealed copper tubing, plastically deforming the material requires significant force. Thus, previously known tools have several configurations to provide mechanical leverage.

Lever expanders, for example, use long levers to impart mechanical leverage to the expander head. These tools are large, bulky, and require two hands to operate, limiting their usefulness, especially in small spaces. Further, though providing significant leverage, it can be difficult to determine the proper force to exert, leading to over-expanding of the tube or even splitting or cracking. Punch-style expanders can also be difficult to use.

Previously-known flaring tools are also difficult to set up. Setting up the flare block and yoke in the correct position to properly flare the tube is time-consuming. Even after set up correctly, such devices are difficult to operate, as the pipe and block must be held while the yoke is operated. In tools utilizing screw mechanisms to drive the flare cone, spinning the handle can be difficult and fatiguing.

SUMMARY OF THE INVENTION

Accordingly, it is an object of the present invention to overcome one or more of the above-described drawbacks and/or disadvantages of the prior art.

In a first aspect, a tube expander has a housing, a set of expandable jaws movable between a retracted position where the jaws can be inserted into an end of a tube, and an actuator operatively coupled to the jaws to expand the jaws and expand the tube. A manually-engageable handle operatively coupled or coupleable to the actuator actuates the actuator and expands the jaws.

In some embodiments, the actuator includes a ratcheting mechanism, which is actuated by moving the handle from a first position toward a second position. In some embodiments, the expander has two handles, and the ratcheting mechanism is actuated by moving the handles relative to each other. In other embodiments, one of the handles is fixed relative to the housing.

In further embodiments, the housing has a threaded portion, and the actuator includes a threaded feed screw that engages the threaded portion of the housing. The feed screw is threadedly advanced in the housing by rotating the handle to expand the jaws. In other embodiments the actuator is a hydraulic or pneumatic drive.

In various embodiments, the expander has a cone slide with a tapered portion. The taped portion is operatively coupleable to the jaws to expand the jaws. The actuator is operatively coupled to the cone slide to cause the cone slide to expand the jaws. In some such embodiments, the cone slide includes a threaded portion that engages threads of the housing. The handle is operatively coupleable to the cone slide. Rotation of the handle rotates the cone slide, threadedly advancing the cone slide via the housing threads relative to expand the jaws. In some such embodiments, the handle is operatively coupled to the cone slide via a transmission or gearbox.

In another aspect, a tube and pipe flaring tool includes a flaring block and a yoke clampable to the flaring block by a clamping mechanism. The yoke has a housing with a threaded release portion that is movable between a first or engagement position and a second or release position, a flaring cone with a tapered flaring surface adapted that is engageable with an internal surface of a tube to deform and/or flare the tube. The flaring cone is actuated by a threaded feed screw operatively coupleable to the flaring cone. Rotation of the handle rotates the feed screw. With the release in the first position, the feed screw threads are engageable with threads of the release to advance the feed screw toward the flaring block, causing the flaring cone to engage and deform the tube. Movement of the release toward the second position disengages the release threads from the feed screw threads, permitting the feed screw to slide relative to the housing. In some embodiments, the feed screw is biased in a direction away from the flaring block, such that when the release is moved toward the release position, the flaring cone is biased out of engagement with the tube.

In yet another aspect, a flaring block for a flaring tool includes first and second block parts that are pivotally connected and pivotable between a closed position and an open position. In the closed position, the first and second block parts define at least one tube hole configured to engage a tube to be flared and defining a flaring portion against which the tube is deformed to flare the tube. Each of the first and second block parts define a portion of the tool hole. In some embodiments, the block parts are biased toward the closed position.

One advantage of the invention is that the expanders and flaring tools are more compact than previous tools. Another advantage is that the tools of the invention provide easier and quicker set up and operation. A further advantage is that the tools of the invention require reduced user effort to actuate. These and other objects and advantages of the present invention, and/or of the currently preferred embodiments thereof, will become more readily apparent in view of the following detailed description and accompanying drawings.

DETAILED DESCRIPTION OF EMBODIMENTS OF THE INVENTION

Figure 1:
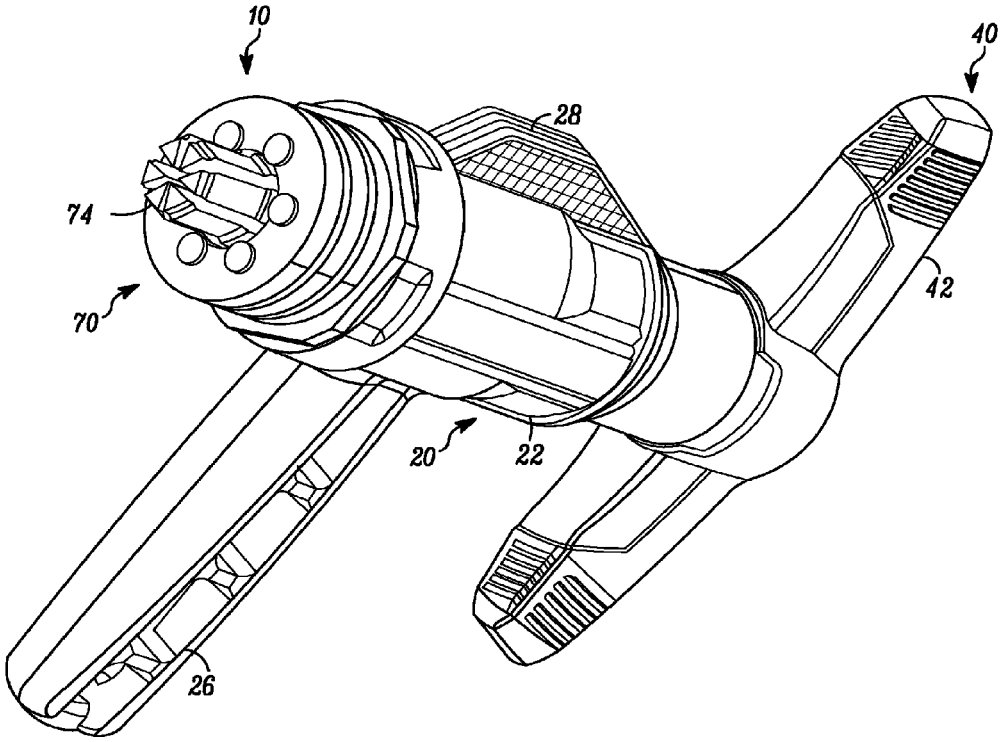
FIG. 1 is a front perspective view of a first embodiment of an expander.

In FIG. 1, a tube expander indicated generally by the reference numeral 10 has a body portion 20, an actuator portion 40, and a head portion 70. The words "tubing" or "tube" as used herein should be understood to mean tubing, such as, for example, copper, aluminum, steel, stainless steel, or other metal tubing, or tubing made with a non-metallic material, piping being made out of any material, a rod material, or any other workpiece onto which it is desired to expand or flare. Further, these terms should be understood to refer to work pieces having any shape or cross-section, e.g., round, oval, rectangular, square, etc.

The body portion 20 has a housing 22 that encloses the internal components of the body portion 20, and first and second holding portions 26, 28 for the user to hold or grasp the expander 10. The head portion 70 contains the expandable head or jaws 74 that expand the tube end in a known manner. The actuator portion 40 contains a handle 42 that is rotatable relative to the body portion 20 to expand the jaws 74. The handle 42 is operatively connected to a hydraulic drive system located inside the housing 22 of the body portion 20 that, as will be understood by those of ordinary skill in the art, is actuated by a user rotating the handle 42 relative to the body portion 20. When the handle 42 is rotated in one direction, e.g., clockwise, it drives a hydraulic ram into the hydraulic cylinder, and the jaws 74 are driven outward to expand the tube. When the handle 42 is rotated in the opposite direction, e.g., counterclockwise, it retracts the hydraulic ram, decreasing the expansion force on the jaws and allowing them to retract radially inwardly. In other embodiments, a pneumatic system is used in place of a hydraulic system.

Figure 2:
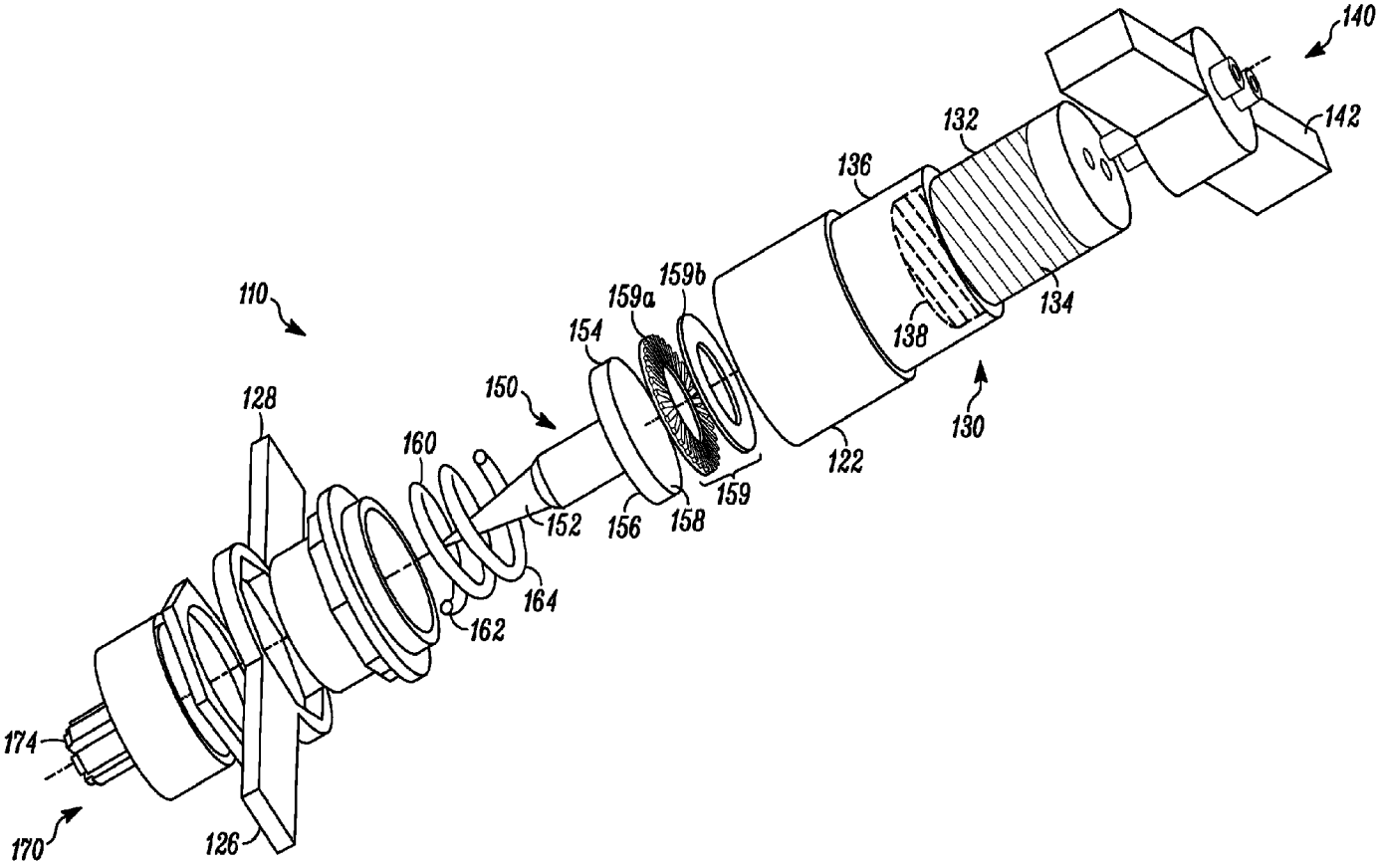
FIG. 2 is an exploded view of a second embodiment of an expander.

FIG. 2 shows an exploded view of another embodiment of an expander indicated generally by the reference numeral 110. The expander 110 is substantially similar to the expander 10 described above with reference to FIG. 1, and therefore like reference numerals preceded by the numeral "1" are used to indicate like elements. A primary difference of the expander 110 in comparison to the expander 10 described above is the mechanism for driving the expander. Instead of a hydraulic or pneumatic system, a feed screw drive 130 drives a cone slide 150.

The cone slide 150 has a tapered forward portion 152, a slide plate 154 at the rearward end of the cone slide 150. The slide plate has a forward-facing surface 156 and a drive surface 158.

The feed screw system 130 has a cylindrical feed screw 132 with external threads 134. The threads 134 engage mating internal threads of a sleeve 136 mounted in the housing 122. As the handle 142 is rotated in a drive direction, e.g., clockwise, the feed screw 132 advances in the housing 122 toward the forward end of the expander 110. A drive end 138 of the feed screw 132 at the forward end of the feed screw 132 engages the drive surface 158 of the cone slide 150, and as the feed screw 132 advances toward the front end, the cone slide 150 is also advanced forward. The tapered portion 152 of the cone slide advances between the expandable portions of the jaws 174, forcing the jaws 174 outward to expand the tube.

A bearing 159 is located between the drive surface 158 and the drive end 138 to reduce friction between the engaging components. In the illustrated embodiment, the bearing 159 comprises a thrust bearing 159*a* and a thrust plate 159*b*. The bearing 159 minimizes transfer of the rotational force of the feed screw 132 to the cone slide 150, reducing torsion forces on the cone slide 150. Those of ordinary skill in the art should understand that other types of bearings, or no bearing, may be utilized in the invention.

When the handle 142 is rotated in the direction opposite the drive direction, e.g., counterclockwise, the feed screw 132 retracts toward the rear of the expander 110, removing the forward driving force from the cone slide 150, permitting the cone slide 150 to retract rearwardly from between the jaws 174 and the jaws 174 to retract inwardly. A biasing member 160 biases the cone slide from a forward position toward a rearward position. In this regard, the biasing member 160 assists in retracting the cone slide 150 from the jaws. In the illustrated embodiment, the biasing member 160 is coil spring. A first end 162 of the coil spring 160 acts against the housing 122, and a second end 164 of the coil spring 160 acts against the forward surface 156 of the cone slide 150. During operation, when the feed screw 132 advances, the coil spring 160 is compressed. When the feed screw 132 is retracted, the spring restoring force acts on the forward surface 156, biasing the cone slide 150 rearwardly out of engagement with the jaws 174. Those of ordinary skill in the art should recognize that although the illustrated embodiment utilizes a coil spring, other types of biasing members may be used in the invention, or no biasing member may be used.

Figure 3:
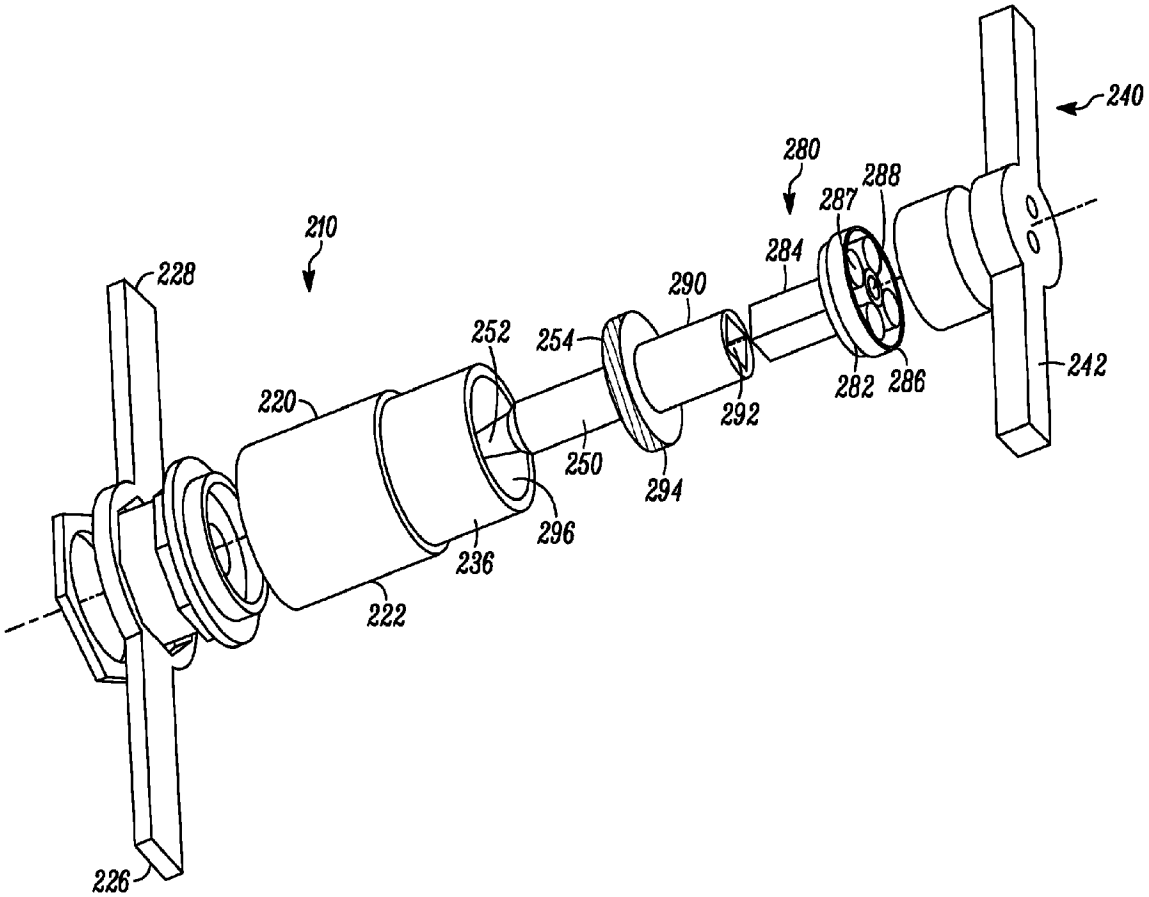
FIG. 3 is an exploded view of a third embodiment of an expander.

FIG. 3 shows an exploded view of another embodiment of an expander indicated generally by the reference numeral 210. The expander 210 is substantially similar to the expander 10 and expander 110 described above with reference to FIG. 1 and FIG. 2 respectively, and therefore like reference numerals preceded by the numeral "2" are used to indicate like elements. A primary difference of the expander 210 in comparison to the expander 10 and expander 110 described above is the mechanism for driving the expander.

The expander 210 has a transmission 280, such as a gearbox, that is operatively coupled between the handle 242 and the cone slide 250. The handle 242 is operatively coupled to the gearbox input 282 and the gearbox output 284 is operative coupled to the cone slide 250. In the illustrated embodiment, the handle is non-rotatably coupled to the gearbox input 282 and the cone slide 250 is non-rotatably coupled to the gearbox output 284. Accordingly, torque generated by rotating the handle 242 rotates the gearbox input 282, passes through the gearbox or transmission 280, rotates the gearbox output 284, and in turn, rotates the slide cone 250.

Though the slide cone 250 is non-rotatably coupled to the gearbox output 284, it is linearly slidable relative to the gearbox output 284. In the illustrated embodiment, this is accomplished by the gearbox output 284 comprising a square shaft that slidably engages a mating square bore 292 in a drive shaft 290 of the cone slide 250. Thus, the gearbox output 284 and the bore 292 are slidable relative to each other while being rotationally coupled. Those of ordinary skill in the art should appreciate that other configurations may be used to achieve slidable engagement and rotational coupling of the gearbox output 284 and the cone slide 250.

The slide plate 254 contains external threads 294 that engage mating internal threads 296 of the sleeve 236. Upon rotation of the cone slide 250, e.g., via rotation of the handle 242, the cone slide 250 advances forwardly or rearwardly (depending on the direction of rotation) relative to the housing 222, and engages and expands, or disengages from the jaws 274, respectively. As the cone slide 250 advances or retracts, the bore 292 slides relative to the gearbox output 284 to maintain rotational coupling therebetween. Thus, upon rotation of the handle 242 in the drive direction, the tapered portion 252 engages and expands the jaws 274 to expand the tube, and upon rotation of the handle 242 in the opposite direction, the tapered portion 252 disengages the jaws 274, permitting the jaws to retract inwardly.

In the illustrated embodiment, the gearbox or transmission 280 comprises a planetary gearbox, with a ring gear 286, sun gear 288, and planetary gears 287. The gearbox input 282 comprises the sun gear 288, and the gearbox output 284 comprises the planetary gears 287. Those of ordinary skill in the art should recognize, however, that other embodiments of the invention utilize other types of gearboxes and gearbox arrangements, and the invention is not limited to any particular gearbox arrangement.

The expanders of the invention possess a number of advantages over previous expanders. The expanders are much more compact than previous expanders such as those having a lever-handle configuration, and more usable in small spaces. The inventive expanders also provide the user more precise control over the amount of force applied to the tube when expanding, helping avoid over-expansion, cracking, and splitting. In addition, the expanders of the invention reduce the amount of effort required to expand.

Figure 4:
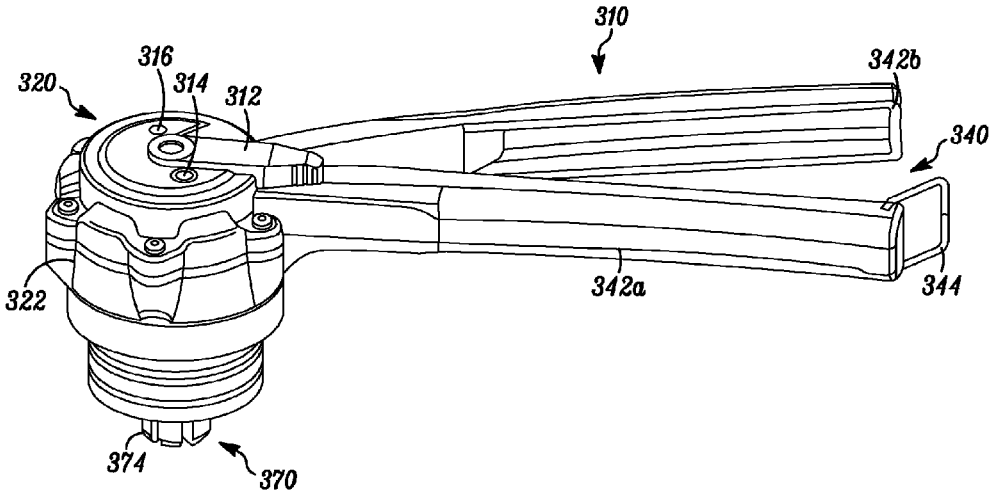
FIG. 4 is a side perspective view of a fourth embodiment of an expander.
Figure 5:
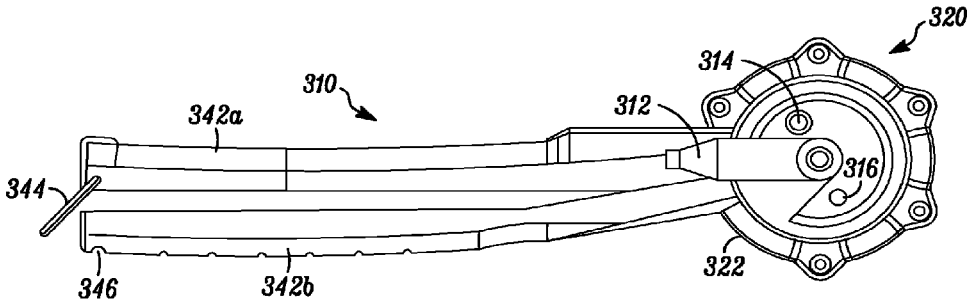
FIG. 5 is a top view of the embodiment of FIG. 4.

FIGS. 4 and 5 show another embodiment of an expander indicated generally by the reference numeral 310. The expander 310 is in some respects similar to the expanders 10, 110 and 210 described above with reference to FIG. 1, FIG. 2, and FIG. 3, and therefore like reference numerals preceded by the numeral "3" are used to indicate like elements. A primary difference of the expander 310 in comparison to the expander 10, 110 and 210 described above is the mechanism for driving the expander.

The expander 310 utilizes a ratcheting mechanism to expand the jaws 374. The ratcheting mechanism is contained within the housing 322 and is configured as is known ratcheting mechanisms as will be understood by those of ordinary skill in the art. In some embodiments, the ratcheting mechanism is operatively coupled to a cone slide and drives the cone slide to expand the jaws in a generally similar manner as the cone slide described above with respect to the FIGS. 1 and 2.

The ratcheting mechanism is actuated by relative movement of the handles 342*a*, 342*b*. FIG. 4 depicts the ratchet handles 342*a*, 342*b* in a first position spaced apart from each other. FIG. 5 depicts the ratchet handles 342*a*, 342*b* in a second position moved toward each other. The handles 342, 342*b* are manually-engageable by a user. Movement of the handles 342*a*, 342*b* from one of the first position and the second position to the other of the first position and the second position actuates the ratchet.

A ratchet release 312 is moveable from a drive position 314 to a release position 316. With the ratchet release 312 in the drive position 314, the ratcheting mechanism is engaged such that movement of the handles 342*a*, 342*b* advances the cone slide and expands the jaws 374. With the ratchet release 312 in the release position 316, the ratcheting mechanism is either disengaged or the ratchet action reversed for retraction of the cone slide and inward retraction of the jaws 374.

A clip 344 is hingedly mounted to one of the handles 342*a*. As seen in FIG. 5, with the handles 342*a*, 342*b* in the second position, the clip 344 can engage a detent 346 in the other of the handles 342*b* to prevent relative outward movement of the handles. In this mode, the expander 310 can be stored utilizing minimal space.

In some embodiments, the handles 342*a*, 342*b* are biased apart from each other by a biasing member, e.g., a spring. In such embodiments, the ratcheting mechanism is actuated by moving the handles 342*a*, 342*b* toward each other, and upon release the of the handles 342*a*, 342*b*, the handles 342*a*, 342*b* are biased apart by the biasing member to move the handles 342*a*, 342*b* to a position for further actuation of the ratcheting mechanism. This feature increases ease of use of the expander. In some of those embodiments, the handles 342*a*, 342*b* are biased apart by a limited amount, allowing one-handed actuation of the handles 342*a*, 342*b* and the ratcheting mechanism.

Though the illustrated embodiment includes two handles, other embodiments of the invention utilize one handle. Movement of the handle relative to the housing 322 actuates the ratcheting mechanism.

The ratcheting mechanism provides various further advantages over previous lever-handle expanders. In addition to the above-described one-handed operation, the ratcheting mechanism achieves a reduced range of motion compared to previous lever-handle expanders, providing a more compact tool. The stepped configuration of the ratcheting mechanism permits more precise control of the amount of expansion force exerted on the tube and the amount of total expansion. Expansion may be applied in a stepped or incremental manner as desired. This reduces the possibility of over-expansion, cracking and splitting. Also, the additional mechanical advantage applied by the ratcheting mechanism as compared to previous expanders reduces the amount of manual effort required by the user to expand a tube.

In further embodiments, the ratcheting mechanism includes a gearbox or transmission. The gearbox further improves control of the expansion process and/or reduces user effort. In some such embodiments, the gearbox includes a planetary gear system.

Figure 6:
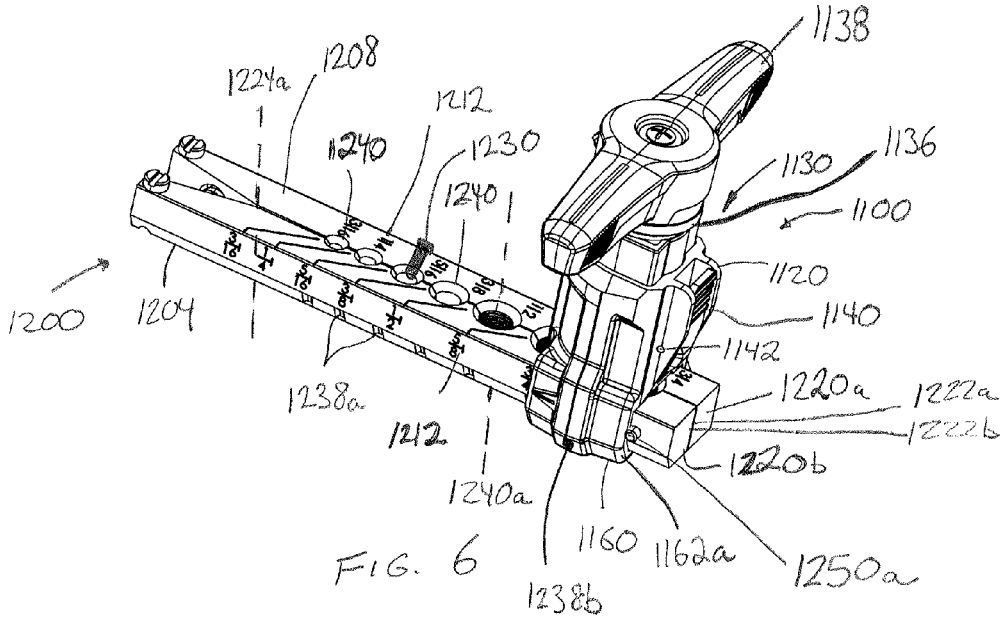
FIG. 6 is a rear perspective view of an embodiment of a flaring tool.
Figure 7:
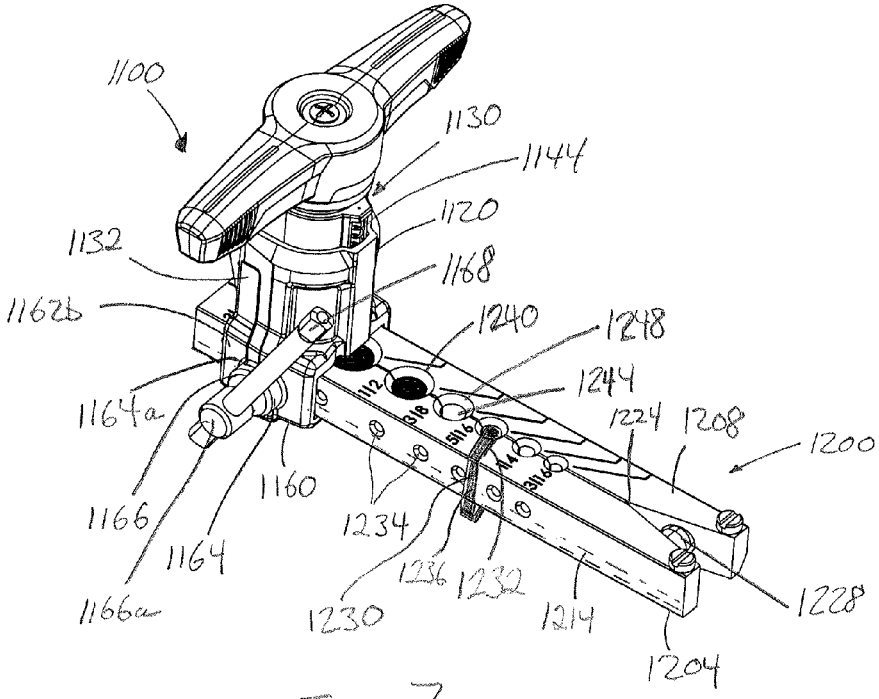
FIG. 7 is a front perspective view of the flaring tool of FIG. 6.
Figure 9:
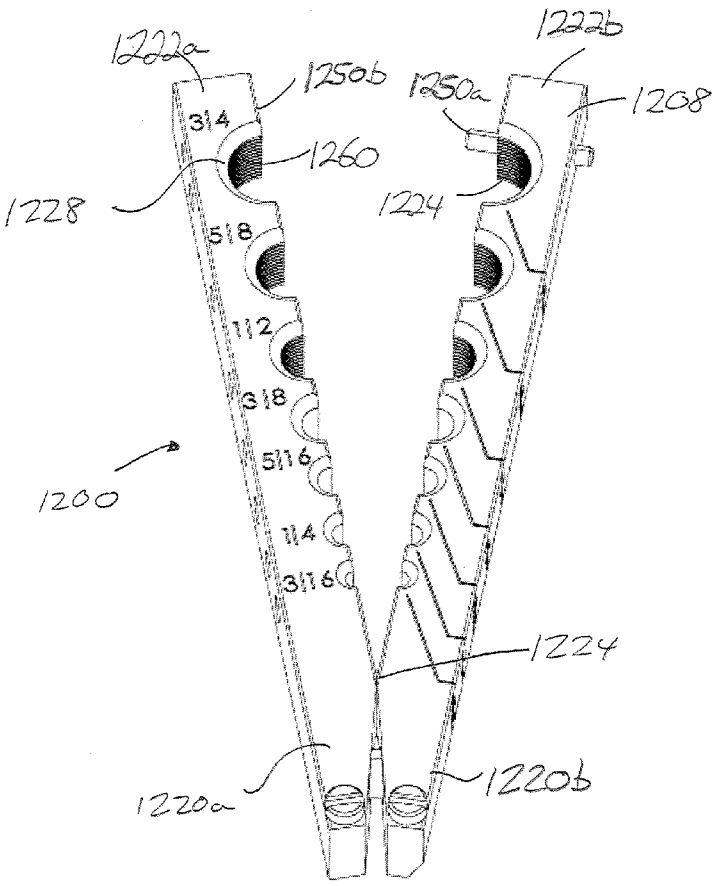
FIG. 9 is the flaring block of FIG. 6 depicted in the open position
Figure 8:
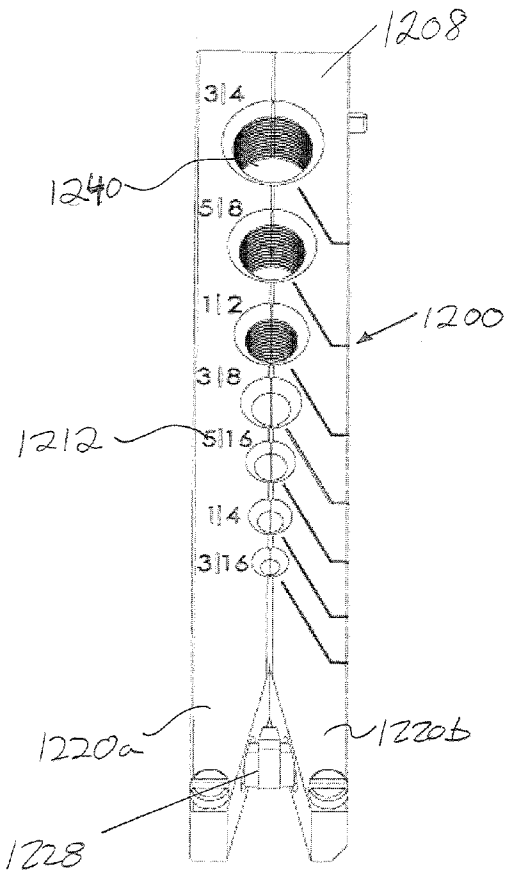
FIG. 8 is a top view of the flaring block of FIG. 6 depicted in the closed position.

In FIGS. 6-7, a flaring tool indicated generally by the reference numeral 1000 comprises a yoke 1100 and a flaring block 1200, also shown in FIGS. 8 and 9. The yoke 1100 has a flaring portion 1120 and a clamping portion 1160 for clamping the yoke 1100 in position on the flaring block 1200, as shown in FIG. 6.

The flaring block 1200 defines a plurality of tube holes 1240 extending through the thickness of the flaring block 1200 generally along a tube hole axis 1240*a*, as shown in FIG. 6. Each tube hole 1240 comprises a gripping portion 1244 (see FIGS. 8 and 9) extending from the bottom surface 1204 of the flaring block 1200 and partially through the thickness of the flaring block, and a flaring portion 1248 extending from the top surface 1208 of the flaring block 1200 and partially through the thickness of the flaring block 1200 to adjoin the gripping portion 1244.

The gripping portion 1244 is configured and dimensioned to closely grip a tube having a particular configuration and/or size. In the illustrated the embodiment, each tube hole 1240 is configured for holding a particularly-sized tube, e.g., 3/16", 1/4", 5/16", 3/8", 1/2", 5/8" and 3/4". The flaring block 1200 includes size indicators 1212 identifying the respective tube sizes of the holes.

The gripping portion 1244 for a respective tube size is dimensioned to closely conform to the outer diameter of the tube to maintain the position of the tube during flaring as is known. As is also known, the flaring portion 1248 extends radially outwardly from the gripping portion 1244 in the direction toward the top surface 1208 of the flaring block 1200. The flaring portion 1248 generally defines the contours of the flared end of the tube after the flaring process.

The flaring block comprises two block parts 1220*a*, 1220*b*. For each tube hole 1240, each block part 1220*a*, 1220*b* forms a portion of the gripping portion 1244 and the flaring portion 1248. Each block part 1220*a*, 1220*b* has a respective inner mating surface 1222*a*, 1222*b* that is configured so that the block parts 1220*a*, 1220*b* can closely engage each other and sufficiently precisely define the tubes holes 1240.

The block parts 1220*a*, 1220*b* are hingedly connected together by a pivot 1224 at one end of the flaring block 1200. The block parts 1220*a*, 1220*b* are pivotable around the pivot axis 1224*a* of the pivot 1224 from a closed position as shown in FIG. 8, and an open position FIG. 9. The pivot axis 1224*a* is substantially parallel to the axes 1240*a* of the tube holes. The pivot 1224 thus permits the block parts 1220*a*, 1220*b* to pivot in a plane that is substantially perpendicular to the tube hole axes 1240*a*.

During use, the block parts 1220*a*, 1220*b* may be pivoted toward the open position to ease insertion of the tube into the tube holes 1240. The above-described planar pivoting motion of the block parts 1220*a*, 1220*b* causes the gripping portions 1244 to engage the outer surface of the tube in a substantially flush manner, as opposed to at an angle that can alter the position of the tube, when the block parts 1220*a*, 1220*b* are pivoted back toward the closed position.

The flaring block 1200 includes a biasing element 1228 adjacent to the pivot 1224 that biases the block parts 1220*a*, 1220*b* toward one of the closed or open positions. In embodiments where the block parts 1220*a*, 1220*b* are biased toward the closed position, the biasing force of the biasing element 1228 assists in setting the tube in the flaring block 1200. In some embodiments, the biasing element 1228 comprises a compression spring. However, those of ordinary skill in the art will recognize other biasing elements or means that are suitable. In yet other embodiments, no biasing element is present.

The flaring block 1200 further includes a height stop 1230. The height stop 1230 is slidably retained to the flaring block 1200 by a groove 1214 in the bottom surface 1204 of the flaring block 1200. The height stop 1230 is slidable along a length of the flaring block 1200 so as to be positionable at the locations of the tube holes 1240. The height stop 1230 has a stop arm 1232 that extends laterally over the top surface 1208 of the flaring block 1200 a sufficient distance to extend over the tube hole 1240. When the stop arm 1232 is located over a tube hole, the stop arm 1232 prevents a tube positioned in the flaring block 1200 from extending outwardly from the top surface 1208 of the flaring block 1200 beyond the stop arm 1232. In this manner, the height stop assists in positioning the end of the tube in the proper position relative to the top surface 1208 of the flaring block 1200, e.g., flush, for proper flaring of the tube end.

The clamping portion 1160 of the yoke 1100 includes opposing clamp arms 1162*a*, 1162*b* that extend laterally from the flaring portion 1120 in partially annular configuration. Accordingly, when the flaring portion 1120 is positioned adjacent to the top surface 1208 of the flaring block 1200, the clamp arms 1162*a*, 1162*b* extends around the sides of the flaring block 1200 and partially extend around the bottom surface 1204 of the flaring block 1200. Thus, the yoke 1100 is slidably engageable with the flaring block 1200 and slidingly positioned into alignment with the tube holes 1240. The clamp arms 1162*a*, 1162*b* extend only partially around the bottom surface 1204 of the flaring block 1200 so as not to interfere with the passage of a tube through the tube holes 1240.

The clamping portion 1160 includes a clamping mechanism 1164 for clamping the yoke 1100 to the flaring block 1200. The clamping mechanism 1164 is configured in a conventional manner as will be understood by those of ordinary skill in the art. In the illustrated embodiment, the clamping arm 1162*b* defines a threaded aperture 1164*a* extending therethrough in a direction substantially perpendicular to the flaring block 1200. A threaded shaft 1166 matingly engages the threaded aperture 1164*a*. The threaded shaft 1166 is threaded into (and out of) the threaded aperture 1164*a* via a lever 1168 operatively coupled to an exterior end 1166*a* of the threaded shaft 1166 that is engageable by the user. As the threaded shaft 1166 is threaded into and through the threaded aperture 1164*a*, an interior end of the threaded shaft 1166 located on the opposite end of the shaft 1166 as the exterior end 1166*a* engages the flaring block 1200 and forces it against the interior surface of the other clamping arm 1162*a*. In the illustrated embodiment, the flaring block 1200 includes clamping recess 1234 into which the threaded shaft 1166 extends to engage the flaring block. When tightened, the clamping force exerted by the shaft 1166 maintains the flaring block 1200 against the clamping arm 1162*a* and the resultant frictional forces prevent the yoke 1100 and flaring block 1200 from moving relative to each other. In addition, the force exerted on block part 1220*a* by the shaft 1166 exerts clamping force on the block parts 1220*a*, 1220*b* between the shaft 1166 and the clamping arm 1162*a*, and, in turn, on a tube positioned in the tube hole 1240 between the block parts 1220*a*, 1220*b*. Those of ordinary skill in the art should understand that the invention is not limited to the illustrated clamping mechanism, and that other clamping mechanisms can be utilized, as will be appreciated, within the scope of the invention.

The flaring portion 1120 include a flaring cone for flaring a tube end set in the flaring block 1200 as is known. The flaring cone has flaring surface defining a narrowing or tapering shape that sufficiently narrows at a distal end of the flaring cone to be inserted into the internal diameter of the tube when the flaring cone is advanced in the direction toward the bottom surface 1204 of the flaring block 1200. The flaring cone expands in a direction away from the distal end to a dimension that is larger than the internal diameter of the tube. The shape of the flaring cone generally complements the shape of the flaring portion 1248 so that when the flaring cone is advanced against the end of the tube with sufficient force, the flaring cone plastically deforms the end of the tube against the flaring portion 1248, creating a flared tube end.

A flaring actuator 1130 is operatively coupled to the flaring cone to advance the flaring cone against the tube end. The flaring actuator includes a housing 1132 enclosing actuation parts. The flaring actuator 1130 includes a threaded feed screw 1136. A yoke handle 1138 is operatively coupled to one end of the feed screw 1136. The end of the feed screw 1136 opposite the yoke handle 1138 is operatively coupled to flaring cone. The feed screw 1136 advances the flaring cone in a similar manner as occurs in the expander described above with reference to FIG. 2.

The flaring actuator 1130 includes a release 1140 that on a side adjoining the interior of the housing 1132 includes a threaded portion that engages in mating fashion with the threads of the feed screw 1136. As the yoke handle 1138 is rotated in a first direction, e.g., clockwise, the feed screw 1136 threadingly advances toward the flaring block 1200 via the threads of the release 1140, and, in turn, advances the flaring cone against the tube end to flare the tube. The release 1140 is movable from a first or engagement position in which the threads of the release 1140 can engage the threads of the feed screw 1136, and a second or disengaged position in which the threads of the release 1140 cannot engage the threads of the feed screw 1136. The release 1140 can thus be moved by a user from the first position to the second position to disengage the release 1140 from the feed screw 1136.

In the illustrated embodiment, the release 1140 includes a lever that is rotatable around a release pivot 1142. In FIG. 6, the release 1140 is shown in the first position. The release 1140 is pivotable around the release pivot 1142 toward the second position, moving the threaded portion of the release 1140 away from the housing 1130 and toward the flaring block 1200.

With the release 1140 disengaged from the feed screw 1136, the feed screw 1136 can slidingly move in the housing 1132. Accordingly, the feed screw 1136 can be retracted in the direction away from the flaring block 1200 by either rotating the feed screw in the reverse direction, e.g., counterclockwise, or by moving the release 1140 toward the second position and sliding the feed screw 1136 in the housing 1132 away from the flaring block 1200. In some embodiments, the feed screw 1136 is operatively coupled to the flaring cone so that movement of the feed screw 1136 away from the flaring block 1200 also retracts the flaring cone away from the flaring block 1200.

In the illustrated embodiment, a biasing member 1144 biases the feed screw 1136 in the direction away from the flaring block 1200. The release 1140 and biasing member 1144 permit the user to quickly retract the flaring cone away from the flaring block 1200. In such embodiments, when the release 1140 is moved toward the second position, the biasing member 1144 acts to retract the feed screw 1136, and thus the flaring cone. In the illustrated embodiment, the biasing member is a spring, e.g., a coil spring. It should be understood, though, that the invention is not limited to use of a spring, and the biasing member can take other forms as will be appreciated by those of ordinary skill in the art. In other embodiments of the invention, no biasing member is utilized.

In some embodiments, a distal portion of the feed screw 1136 (a portion toward the flaring block 1200) is not threaded. In a retracted position in a direction away from the flaring block 1200, the threaded portion of the feed screw 1136 does not engage the threads of the release 1140, even with the release 1140 in the first position. That is, in that retracted position, the non-threaded portion of the feed screw 1136 is adjacent to the threaded portion of the release 1140, but is dimensioned so as to not contact the threads of the release 1140. The non-threaded portion can thereby move toward or away from the flaring block without contacting the release 1140. In order to engage the threads of the feed screw 1136 with the threads of the release 1140, the feed screw 1136 is slidingly advanced in the housing 1132 until the threads of the feed screw 1136 engage the threads of the release 1140. In alternative embodiments, the feed screw 1136 is threaded to the distal end of the feed screw 1136 (in the direction toward the flaring block), but the feed screw 1136 is retractable (away from the flaring block 1200) to a position where the threads do not engage the threads of the release 1140.

In some such embodiments, the feed screw 1136 and flaring cone are positioned within the flaring actuator 1130 so that the flaring cone comes into engagement with the end of the tube set in the flaring block 1200 at the position where the threaded portion of the feed screw 1136 is sufficiently advanced in the housing 1132 to begin engagement with the threads of the release 1140. Thus, from a retracted position, the feed screw 1136 is slidingly advanced in the housing 1132 to bring the flaring cone into engagement with the tube end and bring the threaded portion of the feed screw 1136 into engagement with the threads of the release 1140. When the threaded portion of the feed screw 1136 engages the threads of the release 1140, further sliding advancement of the feed screw 1136 is prevented, i.e., stops. This indicates to the user that the flaring cone has engaged the tube end. The feed screw 1136 is then threadingly advanced along the threads of the release 1140 via rotation of the yoke handle 1138, thereby advancing the flaring cone into the flaring block 1200 to flare the tube. As can be appreciated, the threading action of the feed screw provides mechanical leverage or advantage to generate the force necessary for the flaring cone to flare the tube.

In embodiments containing a biasing member 1144, the biasing member 1144 biases the feed screw 1136 toward a position where the threads of the feed screw 1136 are disengaged from the threads of the release 1140. In order for the user to engage the threads of the feed screw 1136 with the threads of the release, the user slidingly advances the feed screw 1136 in the housing 1132 against the force of the biasing member 1144.

The flaring block 1200 includes yoke alignment detents 1238*a* associated with each tube hole 1240. The yoke alignment detents 1238*a* cooperate with a yoke detent mechanism 1238*b*, e.g., a ball detent, to assist in the aligning the yoke 1100 in the correct position on the flaring block 1200 for a respective tube hole 1240. The yoke detent mechanism 1238*b* releasably engages the yoke alignment detent 1238*a* when the yoke 1100 is correctly aligned. The yoke detent mechanism 1238*b* and yoke alignment detent 1238*a* also provide the user with tactile feedback as to when the yoke 1100 is properly positioned.

In one mode of operation of the flaring tool 1000, a user slides the height stop 1230 along the flaring block 1200 so that the stop arm 1232 is positioned over the desired tube hole 1240. The user next pivots the flaring block 1200 to the open position and inserts the end of the tube to be flared into the tube hole 1240 so that the end of the tube rests against the stop arm 1232. The user then pivots the flaring block 1200 to the closed position so that the gripping portion 1244 engages the outer surface of the tube.

Next, the user places the flaring block 1200 holding the tube in between the clamp arms 1162*a*, 1162*b* and moves the yoke 1100 along the flaring block 1200 until the yoke detent mechanism 1238*b* engages yoke alignment detent 1238*a* for the tubing hole 1240 being used to align the yoke 1100, and thus the flaring cone, in position over the tube end. The movement of the yoke 1100 into position slides the height stop 1230 along the yoke 1100 and away from the tube hole so as not to block actuation of the flaring cone. With the yoke 1100 positioned, the user rotates the threaded shaft 1166 into the threaded aperture 1164*a* via the lever 1168, advancing the threaded shaft 1166 into engagement with the flaring block 1200 until the flaring block 1200 is securely claimed in the yoke 1100.

With the release 1140 in the engagement position, the user pushes the yoke handle 1138 toward the flaring block 1200 against the force of the biasing member 1144, advancing the threads of the feed screw 1136 into engagement with the threaded portion of the release 1140 and the flaring cone into engagement with the end of the tube. The user then rotates the yoke handle to threadingly advance the feed screw along the threads of the release 1140. This advances the flaring cone into the tube end, deforming the tube against the flaring portion 1248, creating the tube flare.

When the flare operation is complete, the user retracts the flaring cone by pivoting the lever 1140 toward the second position to disengage the threads from the threaded portion of the feed screw 1136. After the threads of the release 1140 disengage from the threads of the feed screw 1136, the feed screw 1136 is slidingly retracted in the housing 1132 away from the flaring block 1200, further retracting the flaring cone. The biasing member 1144 assists the retraction.

The user next retracts the threaded shaft 1166 outwardly through the threaded aperture 1164*a*, disengaging the threaded shaft 1166 from the flaring block 1200 to unclamp the yoke 1100 from the flaring block 1200. The user then slides the yoke 1100 off the flaring block 1200, pivots the flaring block 1200 open, and removes the flared tube from the tube hole 1240.

Those of ordinary skill in the art should understand that the above-described mode of operation of the flaring tool 1000 is but one mode of operation, and should appreciate that other modes of operation fall within the scope of the invention. For example, instead of retracting the feed screw 1136 by pivoting the release lever 1140, the user may retract the feed screw 1136 by rotating the yoke handle 1138, e.g., counterclockwise, to threadingly retract the feed screw 1136 and flaring cone away from the flaring block 1200. When the threaded portion of the feed screw 1136 sufficiently retracts to disengage its threads from the threads of the release 1140, the feed screw 1136 is slidingly further retracted. In embodiments utilizing a biasing member 1144, the biasing force thereof assists in the threaded retraction and sliding retraction of the feed screw 1136.

FIGS. 8 and 9 show an enlarged view of the flaring block 1200. A pin 1250*a* located on the inner mating surface 1222*b* of the block part 1220*b* engages a corresponding pin recess 1250*b* located on the inner mating surface 1222*a* of the block part 1220*b*. The pin 1250*a* and pin recess 1250*b* cooperate to help align the block parts 1220*a*, 1220*b* when moving to the closed position and help maintain the alignment of the he block parts 1220*a*, 1220*b* when in the closed position.

Some of the tube holes 1240 have a plurality of threads or raised portions 1260 on the surface of the gripping portion 1244. In other embodiments, the surface of the gripping portion 1244 defines a plurality of recessed portions.

Figure 10:
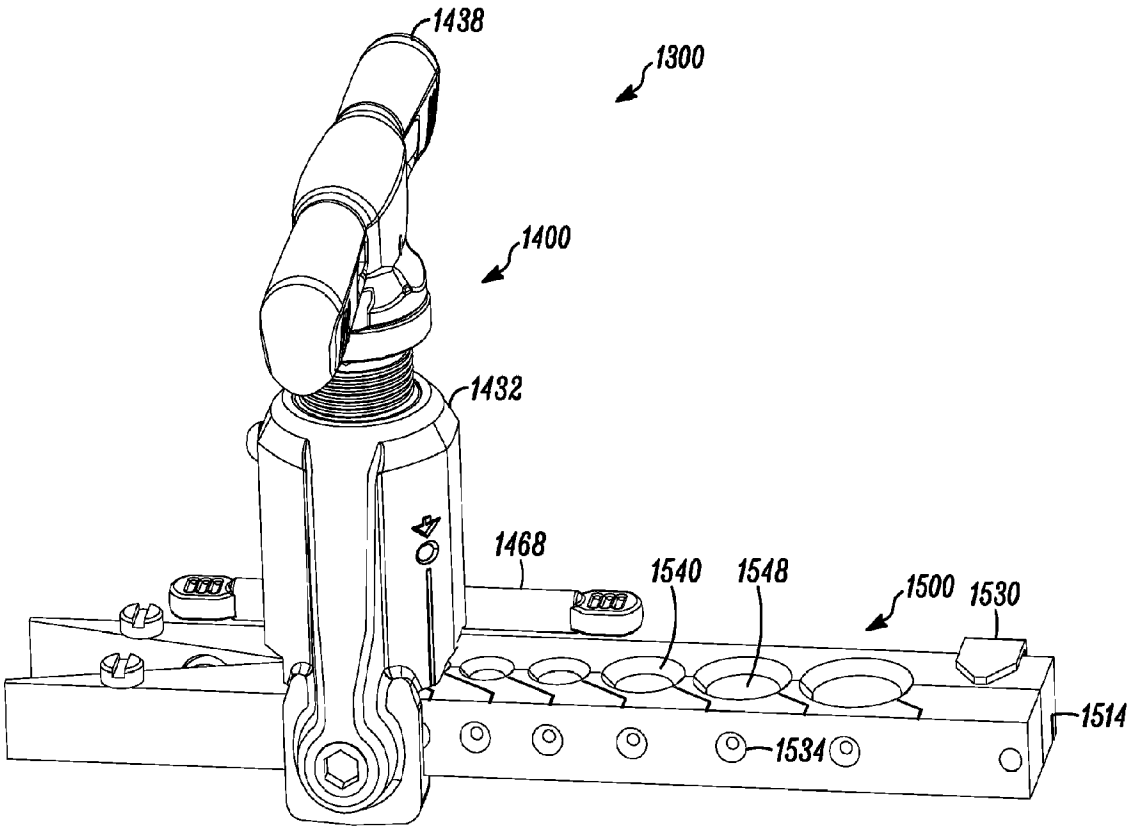
FIG. 10 is a side perspective view of another embodiment of a flaring tool.
Figure 11:
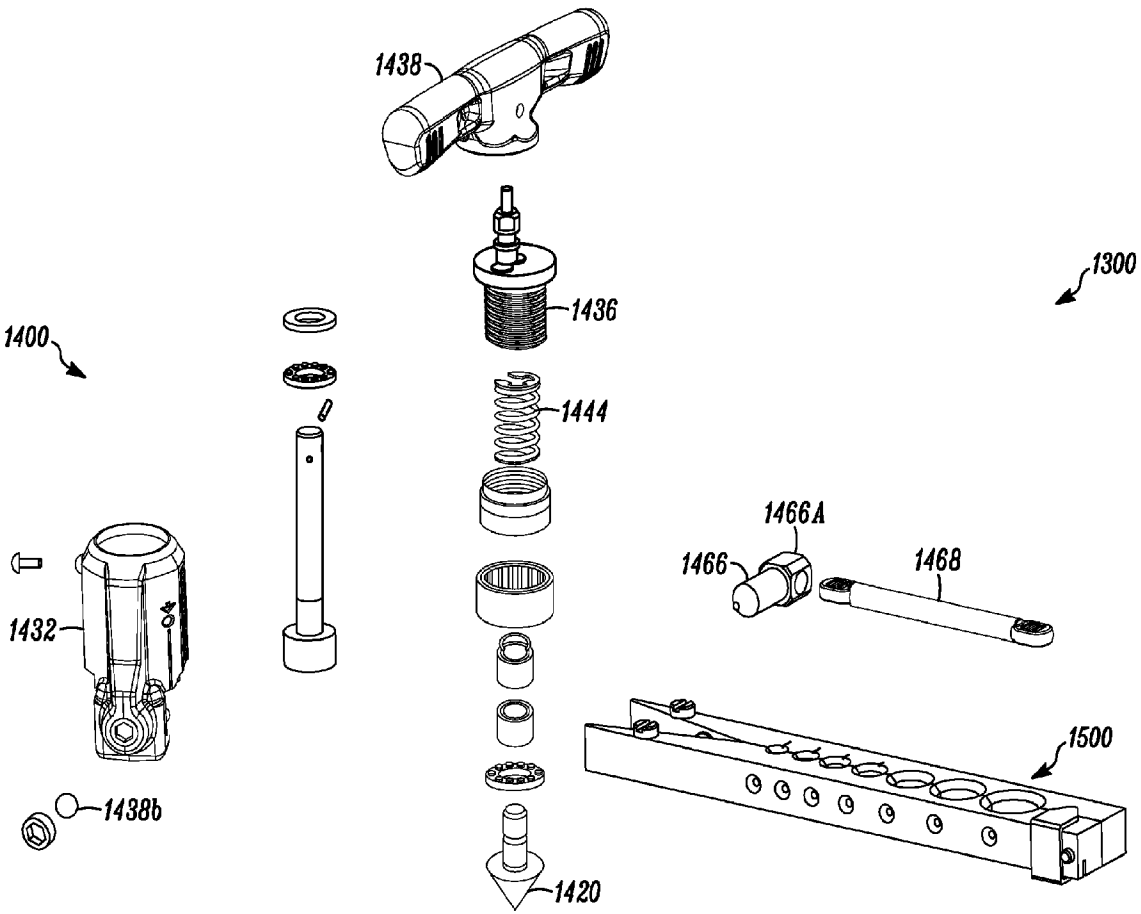
FIG. 11 is an exploded view of the flaring tool of FIG. 10.
Figure 12:
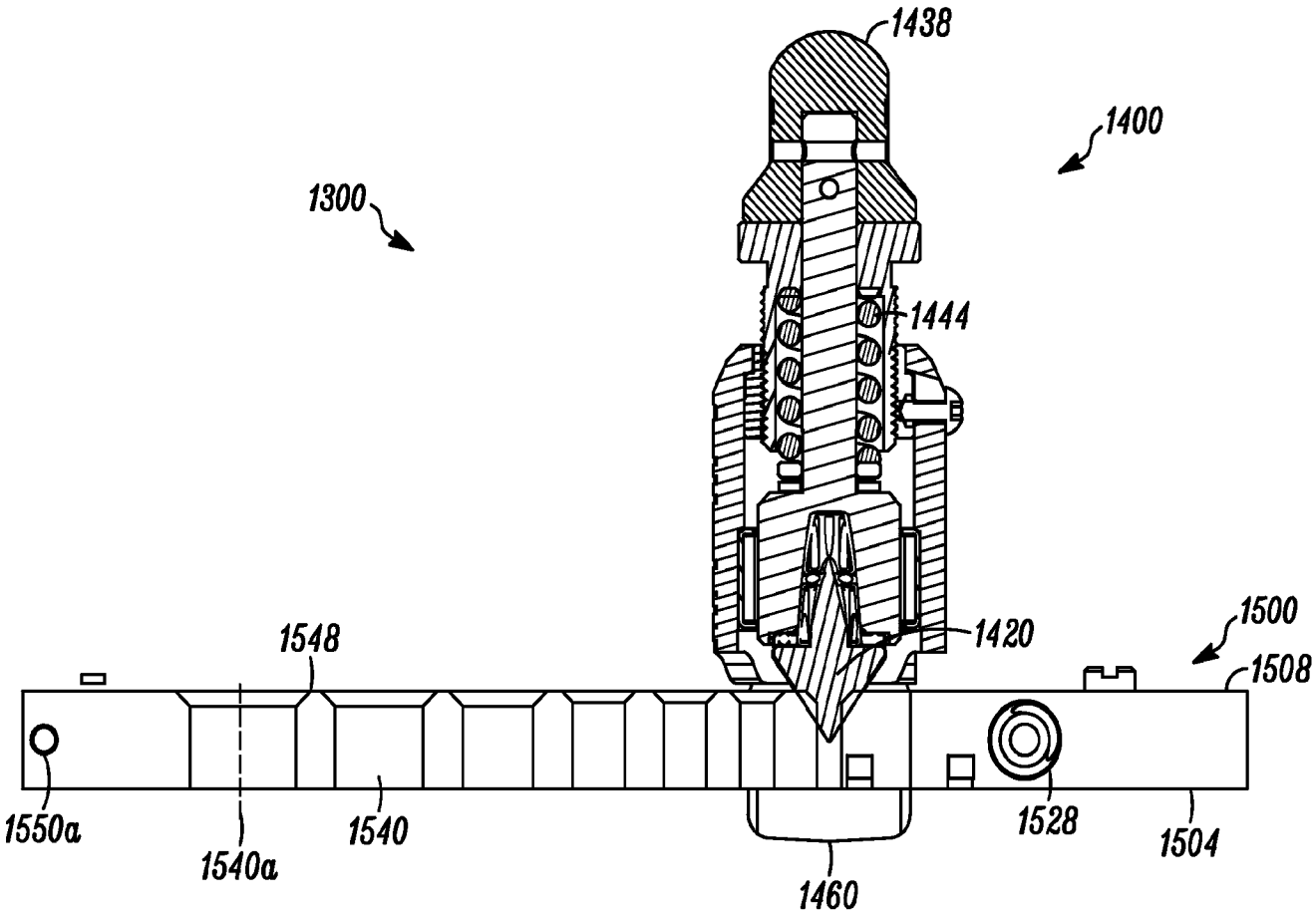
FIG. 12 is a cross-sectional side view of the flaring tool of FIG. 10 along line A-A.

In FIGS. 10-12, another embodiment of a flaring tool is indicated generally by the reference numeral 1300 comprises a yoke 1400 and a flaring block 1500, similar to that shown in FIGS. 6-7. The yoke 1400 has a flaring portion 1420 and a clamping portion 1460 for clamping the yoke 1400 in position on the flaring block 1500.

In this embodiment, the parts of flaring block 1500 are similar to that described with respect to flaring block 1200 of FIGS. 6-9, and are numbered similarly but appended with "15" instead of "12." The yoke 1400 and flaring portion 1420 are structured differently, but share similar features of the embodiment of FIGS. 6-9, and are numbered similarly but appended with "14" instead of "11."

As shown in FIGS. 11 and 12, the yoke 1400 includes a housing 1432 that houses components and/or elements used to flare a pipe or tube end. During use, a flaring portion 1420 is adjacent to the top surface of the flaring block 1500. A biasing member 1444 biases the flaring portion 1420 away from the flaring block 1500. A release, similar in function to the release mechanism described in the embodiments of FIGS. 6-9, permits the user to quickly retract the flaring portion 1420 away from the flaring block 1500. As shown in FIG. 11, the flaring portion 1420 has a cone-shaped flaring cone at the end, adjacent to the yoke. The biasing member 1444 acts to retract the feed screw 1436, and thus release the force against the flaring. It should be understood, though, that the invention is not limited to use of a spring, and the biasing member can take other forms as will be appreciated by those of ordinary skill in the art. In other embodiments of the invention, no biasing member is utilized.

As shown, the feed screw 1436 is shorter than its range of motion with the flaring portion 1420. This permits the feed screw 1436 to be pushed part way into the flaring portion 1420 without the threads engaging the threaded release. This avoids unnecessary rotational motion of the handle 1438. As shown, the threaded portion of the feed screw 1436 is located so that it engages the threaded release when the flaring cone is near or just engages the tube in the flaring block 1500. When the release is actuate, the biasing member 1444 will retract the flaring portion 1420 away from the flaring block 1500, thus disengaging from the tube or pipe that was flared.

Figure 13:
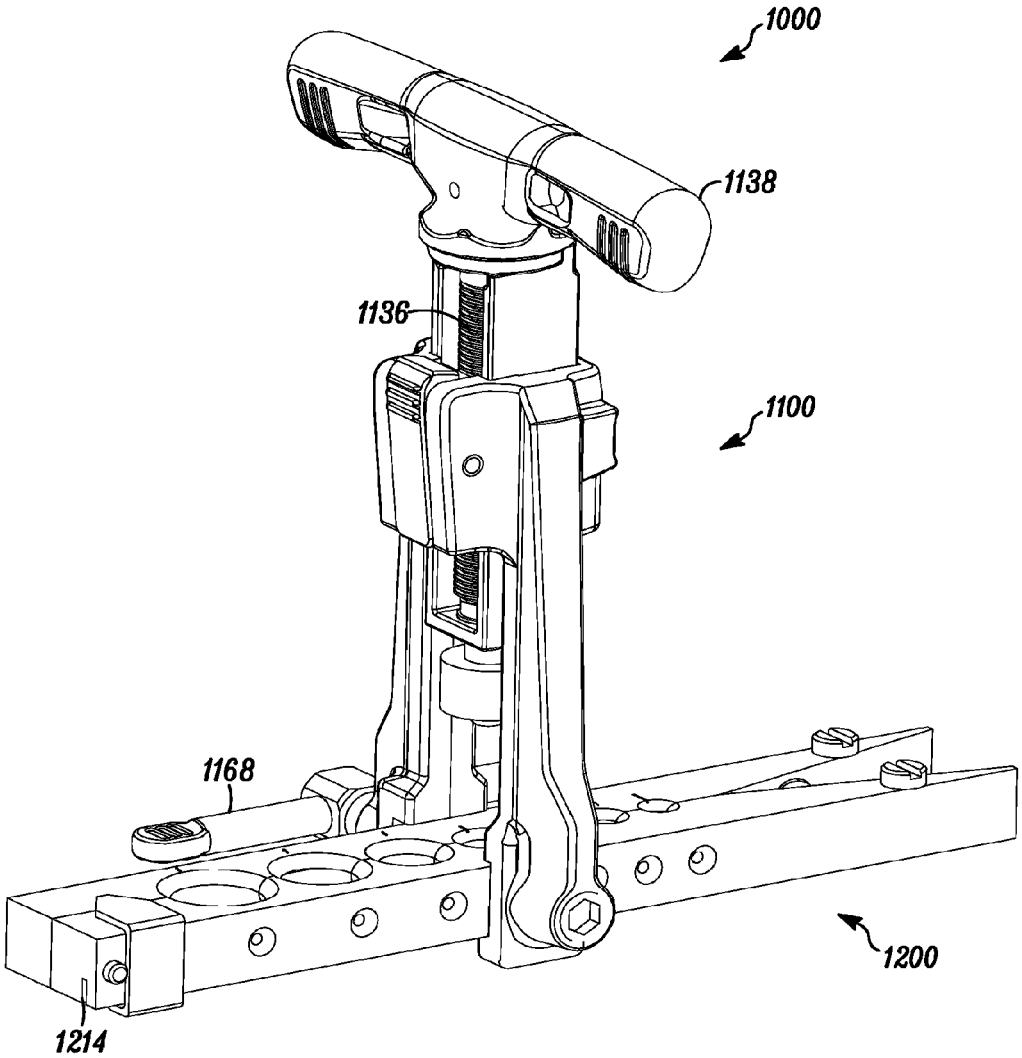
FIG. 13 is a side perspective view of another embodiment of a flaring tool.
Figure 14:
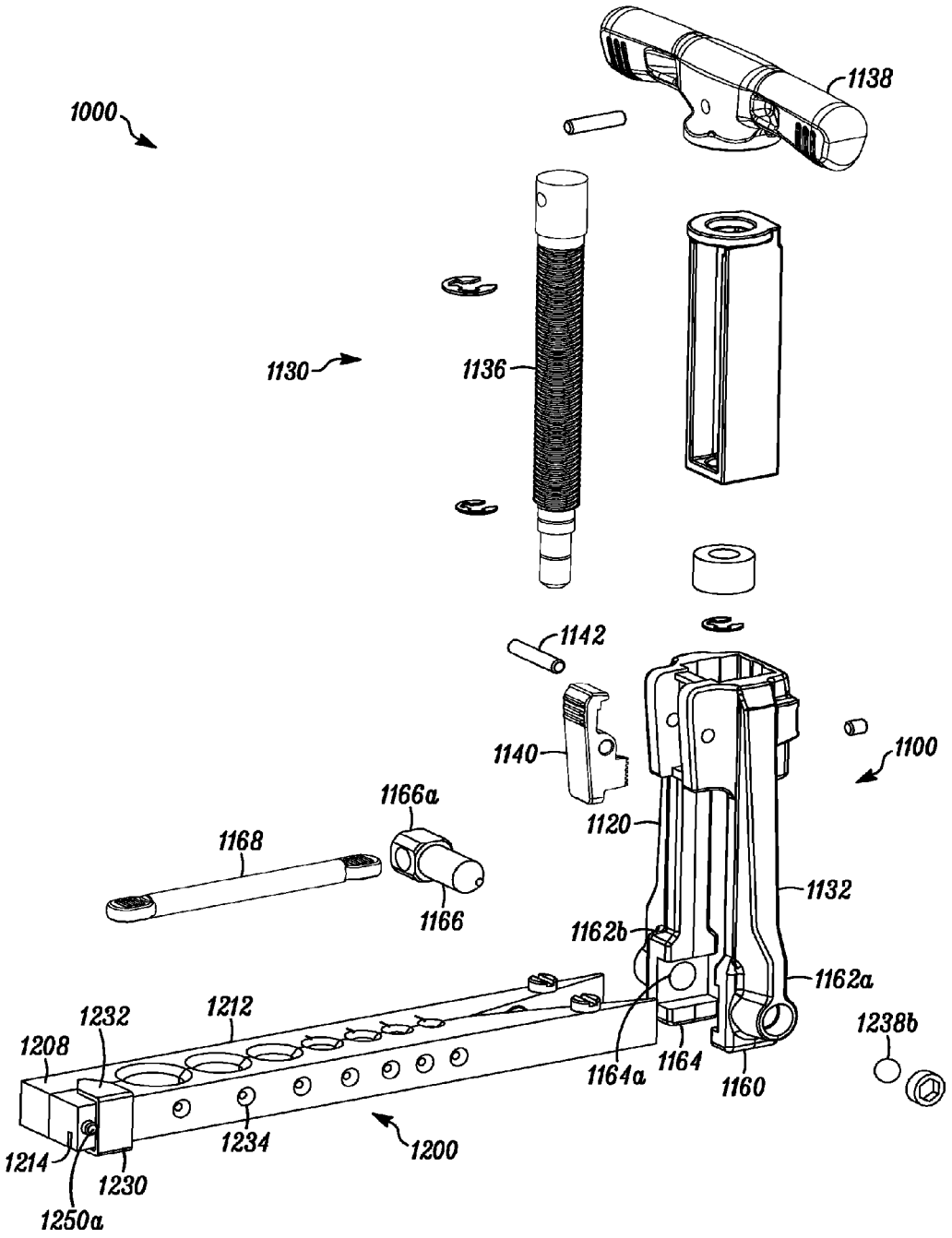
FIG. 14 is an exploded view of the flaring tool of FIG. 14.
Figure 15:
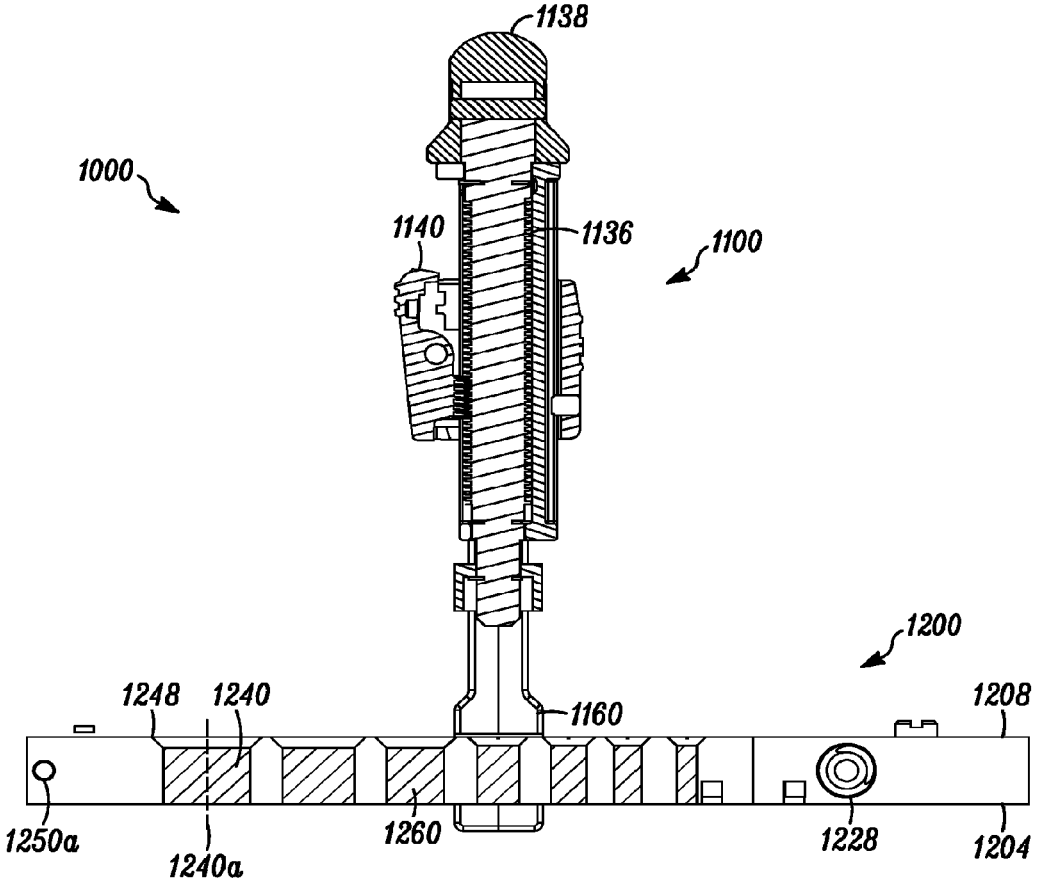
FIG. 15 is a cross-sectional side view of the flaring tool of FIG. 14 along line B-B.

FIGS. 13-15 show another embodiment of a flaring tool. The flaring tool 1000 has a similar structure and elements as described with respect to the embodiments shown in FIGS. 6-12. The flaring tool 1000 includes a yoke 1100 and a flaring block 1200. Flaring block 1200 is similar to that described with respect to FIGS. 6-12. As shown, a difference of flaring tool 1000 is that the feed screw 1136 is not biased in a direction away from the flaring block 1200.

The feed screw 1136 is housed in a feed screw housing 1150, as part of the housing 1132. The release 1140 can hold and/or lock the feed screw 1136 with a threaded portion 1151. As shown in FIG. 15, the release 1140 is rotatable about a release pivot 1142. As configured, the flaring tool 1000 may operate by rotation of the handle. However, those of ordinary skill should appreciate that various elements of the embodiments described may be used interchangeably.

As may be recognized by those of ordinary skill in the pertinent art based on the teachings herein, numerous changes and modifications may be made to the above-described and other embodiments of the present invention without departing from its scope as defined in the appended claims. In addition, though the invention may be used for plumbing, heating, cooling, and HVAC applications, it should be understood that the invention may be utilized for other applications as well. Accordingly, this detailed description of currently preferred embodiments is to be taken in an illustrative as opposed to a limiting sense.

What is claimed is:

1. A flaring block for use in a flaring tool, the flaring block comprising:

first and second block parts pivotally connected and pivotable between a closed position and an open position, the first and second block parts defining a top surface and a bottom surface of the flaring block;

wherein in the closed position the first and second block parts define at least one tube hole extending from the top surface to the bottom surface of the flaring block, the at least one tube hole comprising:

a gripping portion extending partially through a thickness of the flaring block and configured to generally conform to an external surface of a tube and substantially engage the external surface in the closed position; and a flaring portion adjacent to the gripping portion and defining an outward taper in a direction from the gripping portion;

wherein the first block part defines a portion of the gripping portion and a portion of the flaring portion and the second block part defines a portion of the gripping portion and a portion of the flaring portion; and wherein in the open position the portion of the gripping portion defined by the first block part is spaced apart from the portion of the gripping portion defined by the second block part; and a stop comprising a stop portion positionable across a portion of the top surface of the flaring block, the stop being slidably retained in a groove defined in the bottom surface of the flaring block.

2. A flaring block as defined in claim 1, wherein the first and second block parts are biased toward the closed position.

3. A flaring block as defined in claim 1, further comprising a detent associated with a tube hole and adapted to releasably engage a detent mechanism of a yoke to align the yoke with the tube hole, wherein the yoke is adapted to cooperate with the flaring block to flare a tube.

4. A flaring block as defined in claim 3, wherein the detent mechanism is a ball detent.

5. A flaring tool comprising:

a flaring block; and a yoke clampable to the flaring block by a clamping mechanism, the yoke comprising:

a housing;

a flaring cone comprising a tapered flaring surface adapted to engage an internal surface of a tube and deform at least the engaged portion of the tube to a flared condition;

a feed screw movable relative to the housing between a retracted position and an advanced position and operatively coupleable to the flaring cone;

a biasing member configured to bias the feed screw to move relative to the housing toward the retracted position; and a handle operatively coupled to the feed screw, wherein rotation of the handle rotates the feed screw.

6. A flaring tool as defined in claim 5, wherein the housing comprises a release portion comprising first threads, the release portion movable between a first position and a second position, wherein the feed screw comprises second threads, wherein the second threads of the feed screw are engageable with the first threads of the release portion when the release portion is in the first position and the feed screw is in the advanced position, such that rotation of the handle rotates the feed screw to threadedly advance the feed screw relative to the release portion and the housing, and wherein the feed screw is movable between the retracted position and the advanced position without rotation of the feed screw when the release portion is in the second position.

7. A flaring tool as defined in claim 6, wherein the release portion is pivotally mounted to the housing and pivotable between the first position and the second position.

8. A flaring tool as defined in claim 6, wherein when the second threads of the feed screw are disengaged from the first threads of the release portion, the flaring cone is moved out of engagement with the tube by the biasing member.

9. A flaring tool as defined in claim 5, wherein the biasing member is a spring.

10. A flaring tool as defined in claim 6, wherein a distal portion of the feed screw is not threaded, such that the feed screw is movable relative to the housing without rotation of the feed screw when the release portion is in the first position and the distal portion of the feed screw is adjacent to the first threads of the release portion.

11. A flaring tool as defined in claim 6, wherein the second threads of the feed screw are disengaged from the first threads of the release portion when the release portion is in the first position and the feed screw is in the retracted position.

12. A flaring tool as defined in claim 5, wherein the flaring cone engages a tube end of the tube when the feed screw is in the advanced position.

13. A flaring tool as defined in claim 5, wherein the feed screw has a length and a range of motion relative to the flaring block, the length being less than the range of motion.

14. A flaring tool as defined in claim 5, further comprising a detent mechanism configured to align the yoke in a clamping position on the flaring block.

15. A flaring tool as defined in claim 5, wherein the flaring block comprises a first block part and a second block part movable between a closed position and an open position, wherein in the closed position the first and second block parts define at least one tube hole, and wherein in the open position the first block part is spaced apart from the second block part.

16. A flaring tool as defined in claim 15, wherein a biasing element biases the first block part and the second block part toward one of the open position and the closed position.

17. A flaring tool comprising:

a flaring block comprising:

first and second block parts pivotally connected and pivotable between a closed position and an open position, the first and second block parts defining a top surface and a bottom surface of the flaring block;

wherein in the closed position the first and second block parts define at least one tube hole extending from the top surface to the bottom surface of the flaring block, the at least one tube hole comprising:

a gripping portion extending partially through a thickness of the flaring block and configured to generally conform to an external surface of a tube and substantially engage the external surface in the closed position; and a flaring portion adjacent to the gripping portion and defining an outward taper in a direction from the gripping portion;

wherein the first block part defines a portion of the gripping portion and a portion of the flaring portion and the second block part defines a portion of the gripping portion and a portion of the flaring portion; and wherein in the open position the portion of the gripping portion defined by the first block part is spaced apart from the portion of the gripping portion defined by the second block part; and a stop comprising a stop portion positionable across a portion of the top surface of the flaring block, the stop being slidably retained in a groove defined in the bottom surface of the flaring block; and a yoke clampable to the flaring block by a clamping mechanism, the yoke comprising:

a housing;

a flaring cone comprising a tapered flaring surface adapted to engage an internal surface of the tube and deform at least the engaged portion of the tube to a flared condition;

a feed screw movable relative to the housing between a retracted position and an advanced position and operatively coupleable to the flaring cone;

a biasing member configured to bias the feed screw toward the retracted position; and a handle operatively coupled to the feed screw, wherein rotation of the handle rotates the feed screw.

18. A flaring tool as defined in claim 17, wherein the housing comprises a release portion comprising first threads, the release portion movable between a first position and a second position, wherein the feed screw comprises second threads, wherein the second threads of the feed screw are engageable with the first threads of the release portion when the release portion is in the first position and the feed screw is in the advanced position, such that rotation of the handle rotates the feed screw to threadedly advance the feed screw relative to the release portion and the housing, and wherein the feed screw is movable between the retracted position and the advanced position without rotation of the feed screw when the release portion is in the second position.

19. A flaring tool as defined in claim 18, wherein when the second threads of the feed screw are disengaged from the first threads of the release portion, the flaring cone is moved out of engagement with the tube by the biasing member.

20. A flaring tool as defined in claim 18, wherein the second threads of the feed screw are disengaged from the first threads of the release portion when the release portion is in the first position and the feed screw is in the retracted position.

* * * * *